United States Patent [19]

Takebe

[11] Patent Number: 4,488,820

[45] Date of Patent: Dec. 18, 1984

[54] TIME SIGNALLING DEVICE FOR A TIMEPIECE WHICH PRODUCES MUSICAL SOUNDS

[75] Inventor: Katsuhiko Takebe, Machida, Japan

[73] Assignee: Rhythm Watch Co., Ltd., Tokyo, Japan

[21] Appl. No.: 589,050

[22] Filed: Mar. 14, 1984

Related U.S. Application Data

[63] Continuation of Ser. No. 243,353, Mar. 13, 1981.

[30] Foreign Application Priority Data

Mar. 24, 1980 [JP] Japan ..... 55-37227

[51] Int. Cl.[3] ..... G04B 21/00

[52] U.S. Cl. ..... 368/273; 368/75; 368/252; 368/254

[58] Field of Search ..... 368/272, 273, 75

[56] References Cited

U.S. PATENT DOCUMENTS 4,073,133 2/1978 Earls et al. ..... 368/273
4,245,336 1/1981 Stietenroth ..... 368/75
4,271,495 6/1981 Scherzinger et al. ..... 368/75
4,323,995 4/1982 Chiu ..... 368/273

FOREIGN PATENT DOCUMENTS 0134388 10/1980 Japan ..... 368/273
2022880 12/1979 United Kingdom ..... 368/75
2047443 11/1980 United Kingdom ..... 368/273

OTHER PUBLICATIONS

"Music Alarm Clock", Ramsahadeo et al., Electron Today Ing. (GB), vol. 9, No. 12, pp. 32–40, Dec. 1980.

*Primary Examiner*—Bernard Roskoski
*Attorney, Agent, or Firm*—Koda and Androlia

[57] ABSTRACT

A device for generating musical time signalling signals for a timepiece in which combination of the data in ROM installed in the time signalling sound selecting circuit and the controlling action of the time signalling control circuit can simplify the circuit composition performing the complicated and multi-functional time signalling action, and can perform the necessary time signalling action by optional selection to produce a musical sound.

11 Claims, 11 Drawing Figures

TIME SIGNALLING DEVICE FOR A TIMEPIECE WHICH PRODUCES MUSICAL SOUNDS

This is a continuation of application Ser. No. 243,353, filed Mar. 13, 1981.

BACKGROUND OF THE INVENTION

1. Field of Invention

The present invention relates to a time signalling device for a timepiece, and more particularly to a time signalling device for a timepiece electronically generating melody sounds or time striking sounds on the hour and furthermore electronically generating melody sounds or time striking sounds at every 15 minutes after the hour if necessary.

2. Description of Prior Art

There has been well-known time signalling device generating predetermined time striking sounds on the hour or half hour and furthermore generating melody sounds independently or prior to the time striking sounds on the hour and every quarter hour, and there is a good example of westminster clock in practical use. This type of conventional time signalling device is composed of a mechanical time signalling device generating melody sounds or time striking sounds by means of striking stick bells in predetermined order to produce a plurality of defferent sounds, and causes the drawbacks of large and complicated structure. According as recent electronization of timepiece, to the time signalling device is applied the electronic sound generatling means, and time signalling has been performed by melody sounds or time striking sounds electronically synthesized, but complicated circuit composition is required to electronically synthesize the time striking sounds, and cannot obtain such multifunctional time striking device that a user can optionally select melody sounds and that a user can change time striking action according to demand, selection of time striking at a half hour for example.

SUMMARY OF THE INVENTION

Accordingly, it is a general object of the present invention to provide a time signalling device of universal type having simplified circuit composition and enabling the selection of the time signalling sounds and the change of melody sounds.

In keeping with the principles of the present invention, the object is accomplished with a time signalling device which includes an hour signal detector having a hour detecting contact installed in a time indicating gear train to detect an electric hour signal at an indicated time of the hour, a time signalling trigger circuit outputting time signalling trigger signal at requested time signalling time and time signalling sound directing signal based on the hour signal of the hour signal detector, a time striking number detector having a sliding contact in the time indicating gear train to electrically detect time striking numbers corresponding to an indicated time of the timepiece, a time signalling sound selecting circuit having a ROM to memorize melody sound data which accompany time signalling composition data, melody sound data which accompany time striking commencement jump data and time striking sound data which accompany time striking cycle jump data, and having an address counter to read the melody sound data and the time striking sound data corresponding to a striking time out of the ROM, a time striking counter outputting time striking completion signal upon subtraction of the value at every time striking which is determined with the basis of the time striking number signal of the time striking number detector and upon completion of striking the requested numbers, a time signalling control circuit outputting requested melody sound data reading the signal to the time signalling sound selecting circuit in accordance with the time signalling sound directing signal, completing the time signalling action by the time signalling completion data of the ROM, outputting the time striking sound data reading signal to the time signalling sound selecting circuit by the time striking commencement jump data and the time striking cycle jump data of the ROM, and further, completing the time signalling action by the time striking completion signal of the time striking counter, and a sound generator producing the requested time signalling sound in accordance with the selective signal of the time signalling control circuit.

BRIEF DESCRIPTION OF DRAWINGS

The above mentioned features and object of the present invention will become more apparent by reference to the following description in conjunction with the accompanying drawings, wherein like referenced numbers denote like elements, and in which.

DETAILED DESCRIPTION OF THE INVENTION

Figure 1:
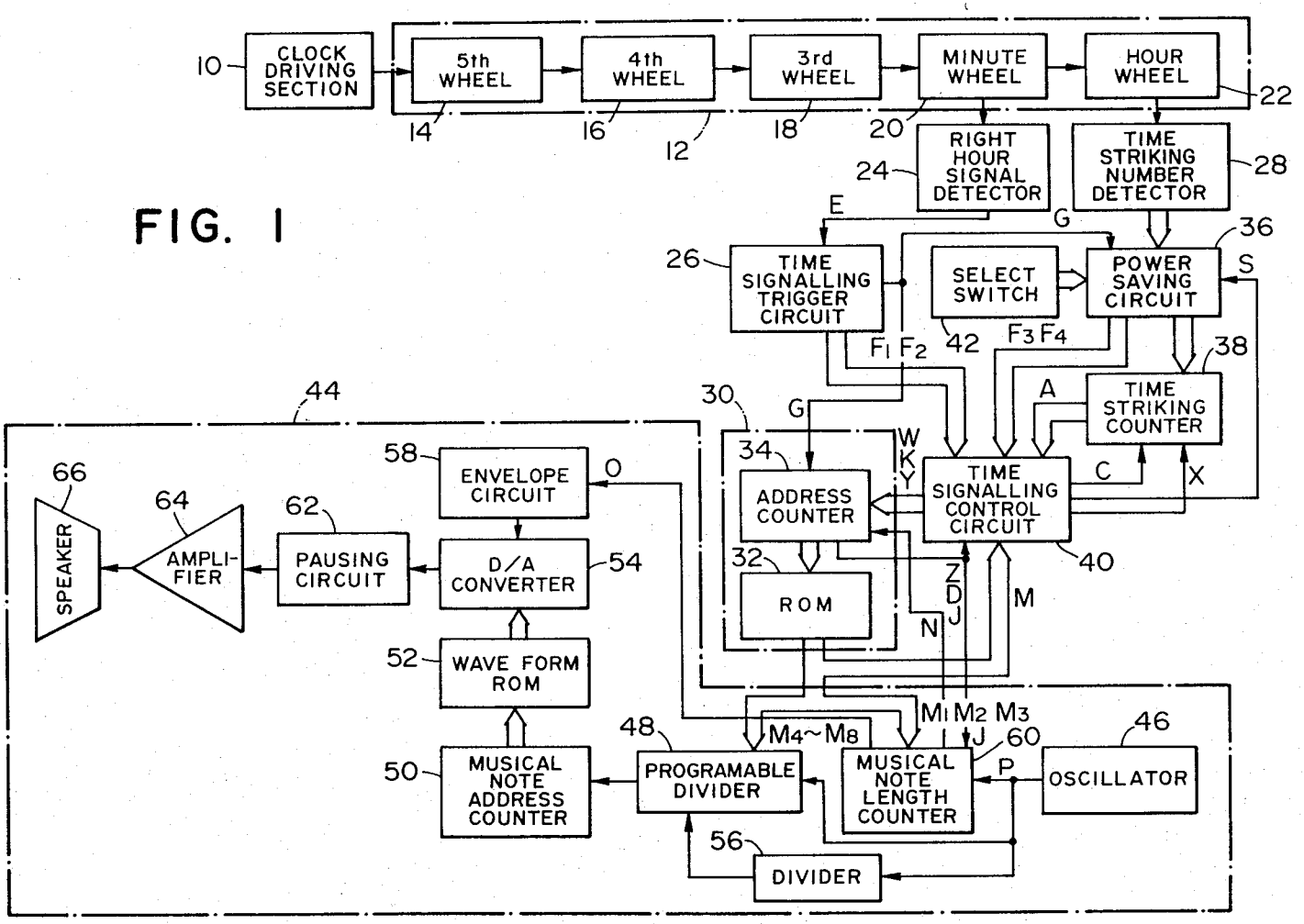
FIG. 1 is a block diagram showing a preferred embodiment of the time signalling device for timepiece in accordance with the teachings of the present invention.

Referring more particularly to the drawings, shown in FIG. 1 is an entire block diagram of the time signalling device for timepiece in accordance with the teachings of the present invention. From a clock driving section 10 including crystal oscillator, etc., constant rotation is output as rotative driving force of pulse motor, etc. with accurate control of the crystal oscillator. The rotative driving power from the clock driving section 10 is transferred to time indicating gear train 12 to perform analog type time display by rotation of an hour hand. In the time indicating gear train 12 installed therein are the fifth wheel 14, the fourth wheel 16, the third wheel 18, the minute wheel 20 and the hour wheel 22, and the time is displayed by the second hand, the minute hand and the hour hand, which are not illustrated, respectively fixed to the fourth wheel 16, the minute wheel 20 and the hour wheel 22.

In order to produce the melody sounds and the time striking sounds to be synchronized with the indicated time of the timepiece there is installed a hour signal detector 24 in the present invention which electrically detects the hour signal at the indicated time of a right hour and which has a right hour detecting contact installed in the time indicating gear train 12. In the embodiment, the hour detecting content is installed with correspondence to the minute wheel 20 to detect the hour signal E by the ON operation of the hour detecting contact at an indicating time of the hour. The hour signal E of the hour signal detector 24 is supplied to a time signalling trigger circuit 26 to output the time signalling trigger signal G and the time signalling sound directing signals $F_1$ and $F_2$ at a requested signalling time with the basis of the hour signal E. The time signalling trigger circuit 26 in the embodiment is consisted of 45 minute counter to output the above mentioned signal G, $F_1$ and $F_2$ at the interval of 15 minutes from the right hour, that is, "15 minutes", "30 minutes" and "45 minutes".

On the other hand, there is installed a time striking number detector 28 in order to detect the time striking numbers at the indicating time of the hour and the half hour. The time striking number detector 28 has a sliding contact installed in the time indicating gear train 12 (the hour wheel 22 in the embodiment) and electrically detects the time striking numbers corresponding to an indicated time of timepiece. The sliding contact in the embodiment is not illustrated in the drawings but it is composed of a contact disc having plural groups of contact points facingly installed to the hour wheel 22 so that the time striking numbers are detected by ON-OFF action of each group of the contact points corresponding to the rotated position of the hour wheel 22.

In order to select the time signalling sound corresponding to each time signalling occasion with the basis of the above mentioned time signalling trigger signal G, there is a time signalling sound selecting circuit 30 which includes a ROM (Read on Memory) 32 and an address counter 34. The ROM 32 in the present invention consists of digital memory and memorizes melody sound data which accompany time signalling completion data, melody sound data which accompany time striking commencement jump data and time striking sound data which accompany time striking cycle jump data. The address counter 34 performs addressing action which reads the melody sound data and the time striking sound data corresponding to each signalling time out of the ROM 32.

The time signalling number signal of the above mentioned time signalling number detector 28 is supplied to the time striking counter 38 by way of a power saving circuit 36 to determine the time striking numbers in the time striking counter 38 on the basis of the time striking number signal. The determined numbers in the time striking counter 38 are reduced every time striking and the time striking completion signal A is output upon completion of time striking numbers.

The time signalling sound selecting action of the above mentioned time signalling sound selecting circuit 30 is controlled by a time signalling control circuit 40 which outputs the requested melody sound data read out signals to the time signalling sound selecting circuit 30 in accordance with the time signalling sound directing signals $F_1$ and $F_2$ of the time signalling trigger circuit 26, and which completes the time signalling action by the time signalling completion data of the ROM 32, during which the time signalling control circuit 40 controls the predetermined melody sound selecting action of the time signalling sound selecting circuit 30. The time signalling control circuit 40 also supplies the time striking sound data read out signal to the time signaling sound selecting circuit 30 by means of the time striking commencement jump data and the time striking cycle jump data of the ROM 32, and further completes the time signalling action by the time striking completion signal A of the time striking counter 38, during which the time signalling control circuit 40 controls the time striking sound selecting action of the time signalling sound selecting circuit 30. In FIG. 1 the melody sound data read out signal and the time striking sound data read out signal are shown as control program signal Y, and the time signalling completion data, the time striking commencement jump data and the time striking cycle jump data of the ROM 32 are shown as a ROM program signal M of the ROM 32.

In the embodiment, when the time striking action is not required, the power saving circuit 36 can void the time striking counter 38 to reduce the consumption of time striking electric power. In the above mentioned ROM 32, the melody sound data is memorized in plurality and the time signalling melody can be selected by the users' preference by a select switch 42. The melody selecting action is performed by the supply of the melody select signals $F_3$ and $F_4$ to the time signalling control circuit 40.

The select signal of the time signalling sound selecting circuit is supplied to a sound generator 44 as ROM program signal M to perform sound producing action of requested time signalling which includes the melody sounds and the time striking sounds. The sound generator 44 includes an oscillator 46 outputting basic sound signal P which has necessary basic frequencies in order to synthesize the time signalling sounds, and the basic sound signal P is divided into the frequencies addressed by the ROM program signal M in a programmable divider 48 to be changed into the requested signal of musical notes. This signal of musical notes is converted into the analog musical note signal by a musical note address counter 50, a wave form ROM 52 and a D/A converter 54, and the analog musical note signal is provided with a vibrato by a divider 56. The signal of musical notes is further provided envelope attenuating action by an envelope circuit 58 and the analog musical note signal is obtained with good quality of similarity to the signalling sound produced by the conventional mechanical stick bells. The signalling length of the musical notes is determined by a musical note length counter 60 controlled by the ROM program signal M, and the signalling length of the analog musical note length signal is decided by the supply of musical note length signal O to the envelope circuit 58. The analog musical note signal which is the output of the D/A converter 54 is supplied to an amplifier 64 by way of a pausing circuit 62 of the time signalling, and the time signalling acton is performed through the speaker 66 after the determined amplifying action. The pausing circuit 62 of the time signalling is to void the time signalling action during sleep at night and to prevent the analog musical note signals from conducting to the amplifier 64 between the predetermined times.

The musical note counting up signal N of the above mentioned musical note length counter 60 is supplied to the address counter 34 and used as count trigger signals to advance the melody sound data of the ROM 32 one after another.

The composition of the present invention is evident from the description made in the above text and a further detailed composition of each portion is described hereinafter on the basis of FIGS. 2 through 8.

Figure 2:
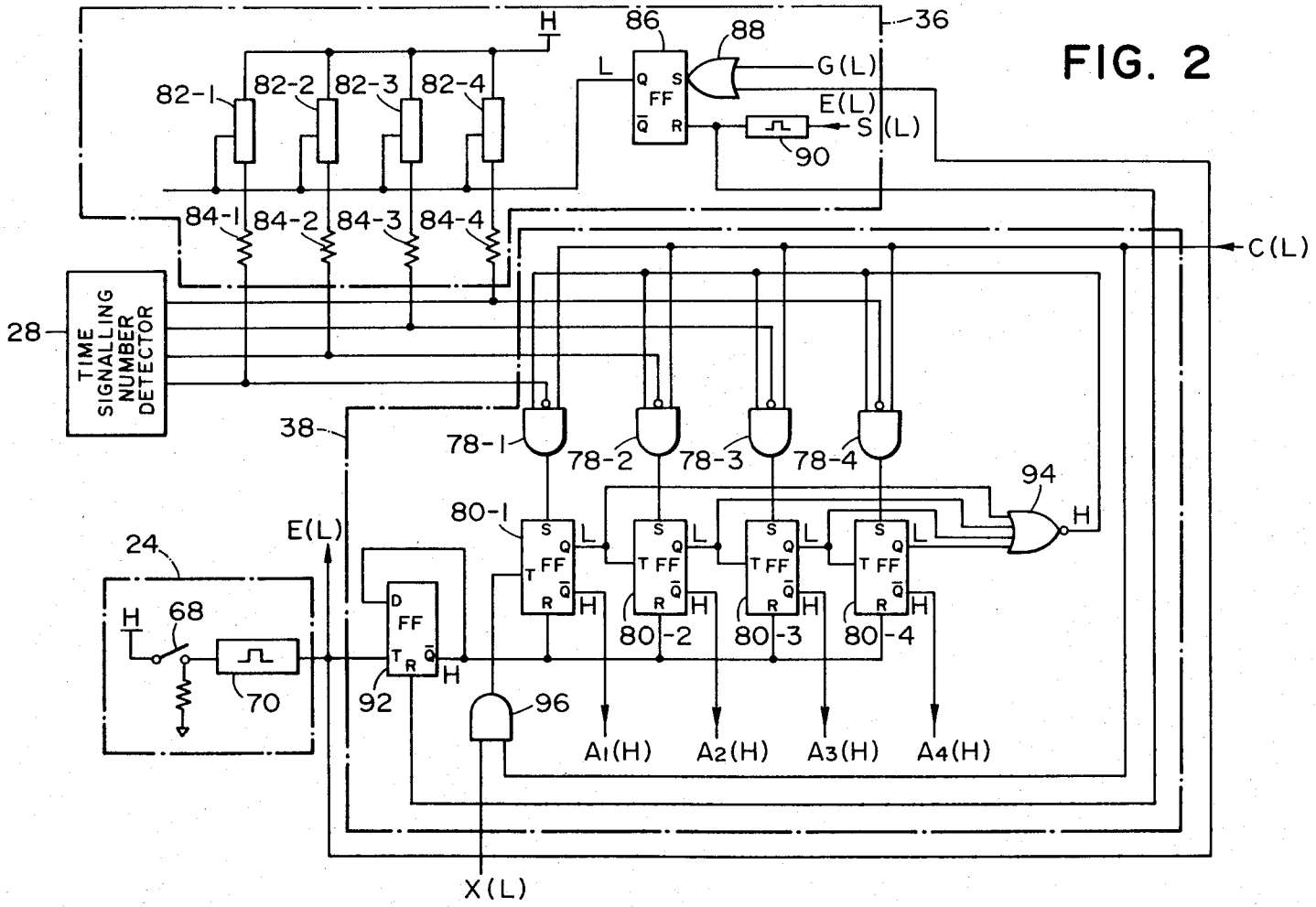
FIG. 2 is a circuit diagram showing a right hour signal detector, a time striking number detector, a power saving circuit and a time striking counter in FIG. 1.

In FIG. 2 the right hour signal detector 24 includes a right hour detecting contact 68 connectedly installed to the minute wheel 20 and a one shot circuit 70, and the hour signal E supplied with the determined pulse width by the ON action of the contact 68 at the right hour of the indicating time.

The hour signal E is supplied to the time signalling trigger circuit 26 to reset a counter 72, flip flop (hereinafter referred as to FF) 74 and 76. The counter 72 outputs the time signalling trigger signal G every 15 minutes after the hour as well as the counter 72 outputs time signalling sound directing signals $F_1$ and $F_2$ which are composed of binary numeral and advance each of FF 74 and 76 every 15 minutes to change at 15 minutes interval dividing one hour after the hour into the quarter. In other words, every 15 minutes after the hour the time signalling sound directing signals $F_1$ and $F_2$ changes as written in the following:

| | $F_1$ | $F_2$ |
|---|---|---|
| 0–15 min. | 0 | 0 |
| 15–30 min. | 1 | 0 |
| 30–45 min. | 0 | 1 |
| 45–0 min. | 1 | 1 |

In FIG. 2, the sliding contact groups of the time striking number detector 28 outputs the time striking number signal of four bit so that the time striking number signal corresponding to each of indicating times is applied to the time striking counter 38 to determine the time striking numbers at FF 80-1 through 80-4 by way of AND gates 78-1 through 78-4. The ON action of the AND gate group 78 is controlled by the outputs of the time striking commencement signal C of the time signalling control circuit 40 and the power saving circuit 38, which is described about later. The power saving circuit 36 includes an analog switch group 82, a resister group 84 and FF 86 which are respectively connected to the time striking number detecting signal lines, and the ON state of the FF 86 makes the writing of the time striking number signal to the time striking counter 38 be effective. In the reset state of FF 86 the above mentioned writing becomes ineffective to save the electric power consumption. In order to set FF 86 the above mentioned right hour signal E and time signalling trigger signal G are applied to the set input of FF 86 by way of an OR gate 88. In the embodiment, FF 86 is set at 15 minutes interval and the time signalling completion signal S of the time signalling control circuit 40 is applied by way of the one shot circuit 90. FF 86 is thus reset upon completion of time signalling.

The FF group 80 of the time striking counter 38 is reset by $\overline{Q}$ signal of FF 92 which is reset by the time signalling completion signal S. The reset state of FF 92 is released by the right hour signal E, and the time striking commencement signal C opens the AND gate group 78 so that the time striking number signal from the time striking number detector 28 is written into each of FF 80. Since the Q outputs of each FF 80 are connected to the inputs of each AND gate 78 by way of a NOR gate 94, the writing action of FF group 80 is performed only in the reset state of each FF 80. In the time striking action in the sabtracting state of the time striking counter the AND gate group 78 stays in the OFF state at the output of the NOR gate 94, and the time striking number signal of the time striking number detector 28 is prevented from applying to the time striking counter 38. The time striking count up signal X is supplied to a trigger input of FF 80-1 in the first stage. When the AND gate 96 is in the ON state by the time striking commencement signal C the FF 80-1 is driven by the time striking count up signal X at every one production of time striking counds. Since the FF group 80 forms counters with series connection, its determined values are subtracted at every production of time striking sounds. Upon completion of desired numbers of time striking, the $\overline{Q}$ outputs of the all FF 80 becomes "H" signals, and the time striking completion signals shown as $A_1$ through $A_4$ are output to the time signalling control circuit 40.

Figure 3:
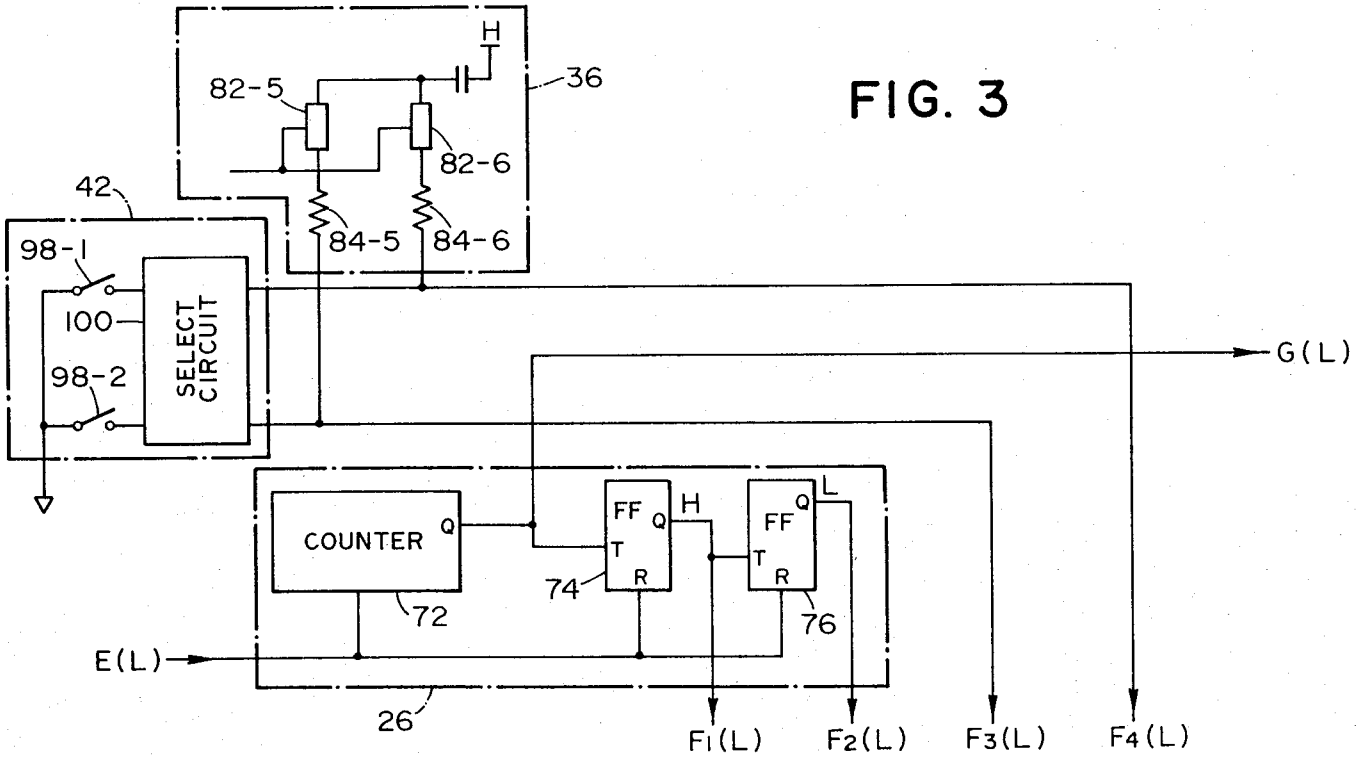
FIG. 3 is a circuit diagram showing a time signalling trigger circuit and a selective switch in FIG. 1.

The select switch 42 in FIG. 3 includes manually operated switches 98-1 and 98-2 and a select circuit 100, and the above mentioned switches 98-1 and 98-2 change over melody selecting signals $F_3$ and $F_4$. In the embodiment three different kinds of melody sound data memorized in the ROM can be optionally selected.

Figure 4:
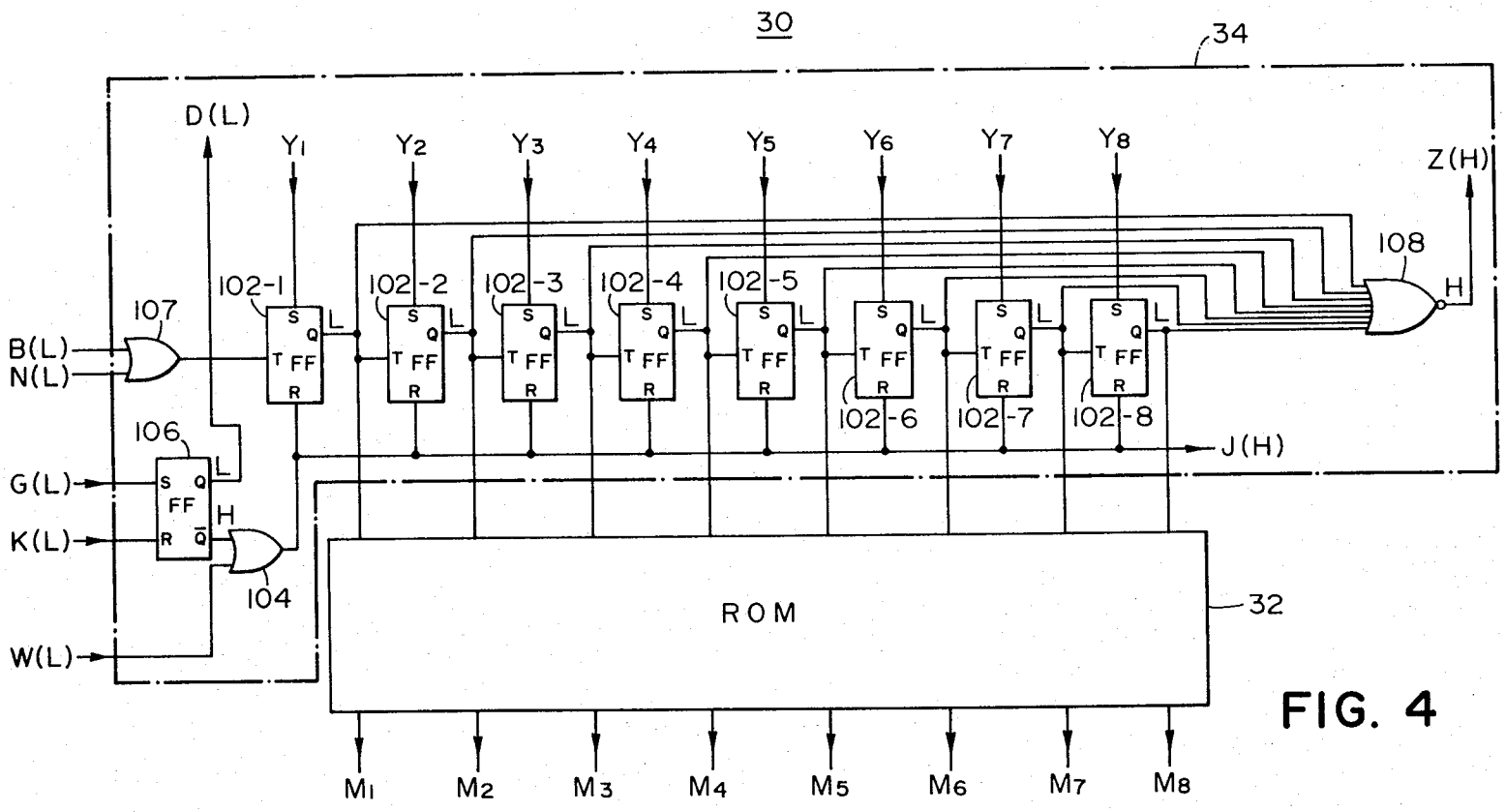
FIG. 4 is a circuit diagram showing a time signalling sound selecting circuit in FIG. 1.

In FIG. 4, shown therein is the time signalling sound selecting circuit 30, and the memorized data of the ROM 32 are read out by the address of the FF group 102 in the address counter 34.

Figure 5:
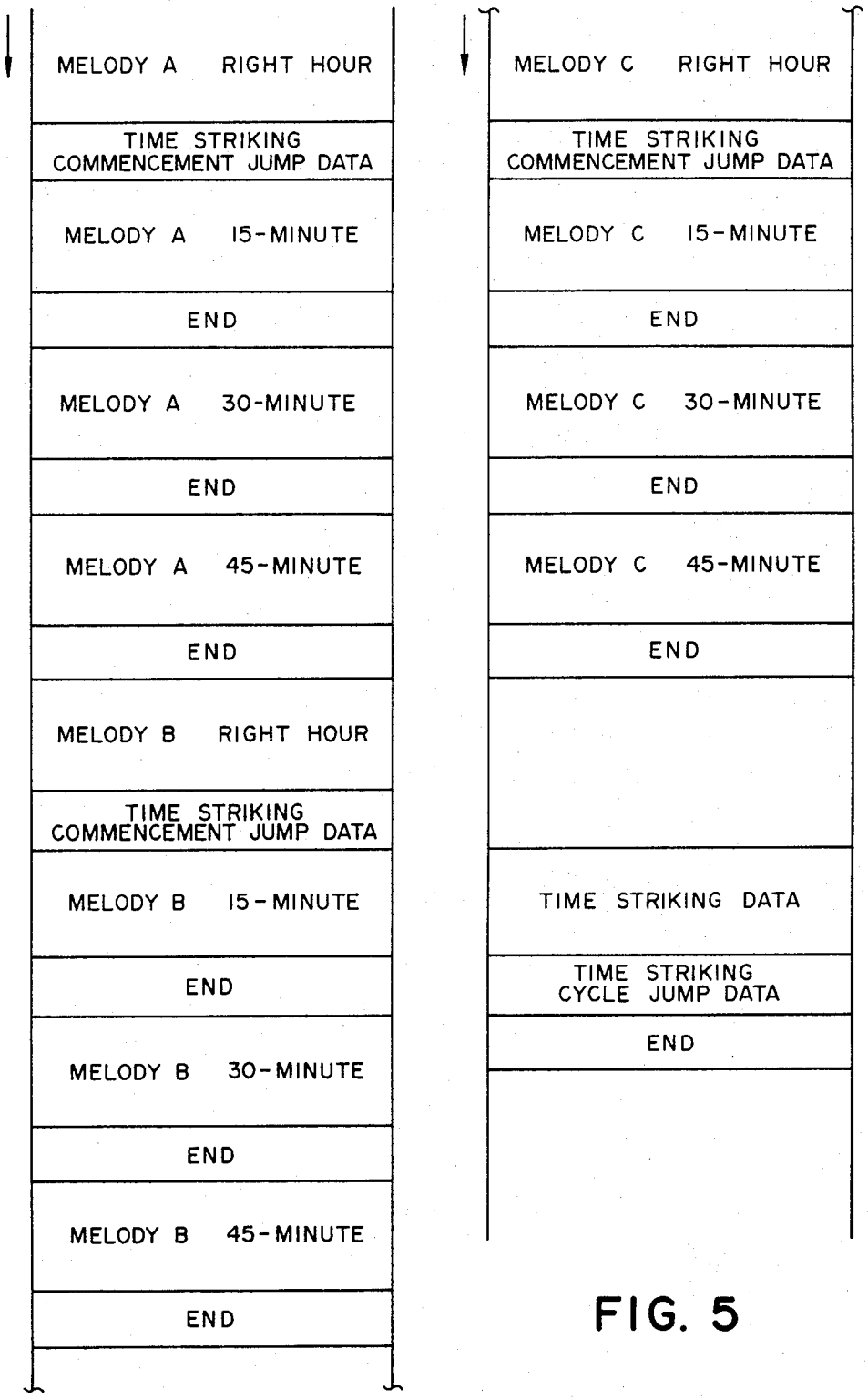
FIG. 5 is an illustration describing memorized contents of ROM of FIG. 4.

In FIG. 5, shown therein is an example of memorized contents of the ROM 32 and the memorized contents hold three kinds of melody A, melody B and melody C, and the time striking sound data. Each of the melody sound data are composed of the melody sound data corresponding to the right hour which accompanies the time striking commencement jump data and the melody sound data corresponding to "15 minutes", "30 minutes" and "45 minutes" which accompany the time signalling completion data, and the time striking sound data accompany the time striking cycle jump data. On the basis of the requested address by the address counter 34 the ROM 32 outputs the ROM program signals $M_1$ through $M_8$ of the data corresponding to the addressed. Accordingly, the ROM program signal M can produce signalling sounds from the sound generator 44 which is hereinafter described about and can output the control signal to the time signalling control circuit 40.

To the FF group 102 of the address counter 34 control program signals $Y_1$ through $Y_8$, which are described about afterwards, from the time signalling control circuit 40 are supplied as setting input, and the control program signal Y can direct the requested content of ROM memories. The FF group 102 is reset by the $\overline{Q}$ output of FF 106 and the time striking reset signal W which is supplied by way of the OR gate 104. The FF 106 is set by the time signalling trigger signal G and reset by the melody reset signal K of the time signalling control circuit 40. The output of the OR gate 104 is shown as reset signal J. To the trigger circuit of FF 102-1 in the first stage among the FF group 102 which are connected in series to form counters supplied are the musical note count up signal N and the time striking completion address signal B of the time signalling control circuit 40 by way of OR gate 107 to advance the counter by one step whenever the time striking sound is produced once and the time striking action is completed, and the address of the ROM 32 is advanced one after another. Furthermore, each of Q outputs from FF 102 is connected to the input of the NOR gate 108 and supplied to the time signalling control circit 40 as control program hold signal Z. It is only in the reset state of all the FF 102 that the writing of the control program signal Y is performed, and upon this writing the following writing is held back by the control program hold signal Z.

Figure 6:
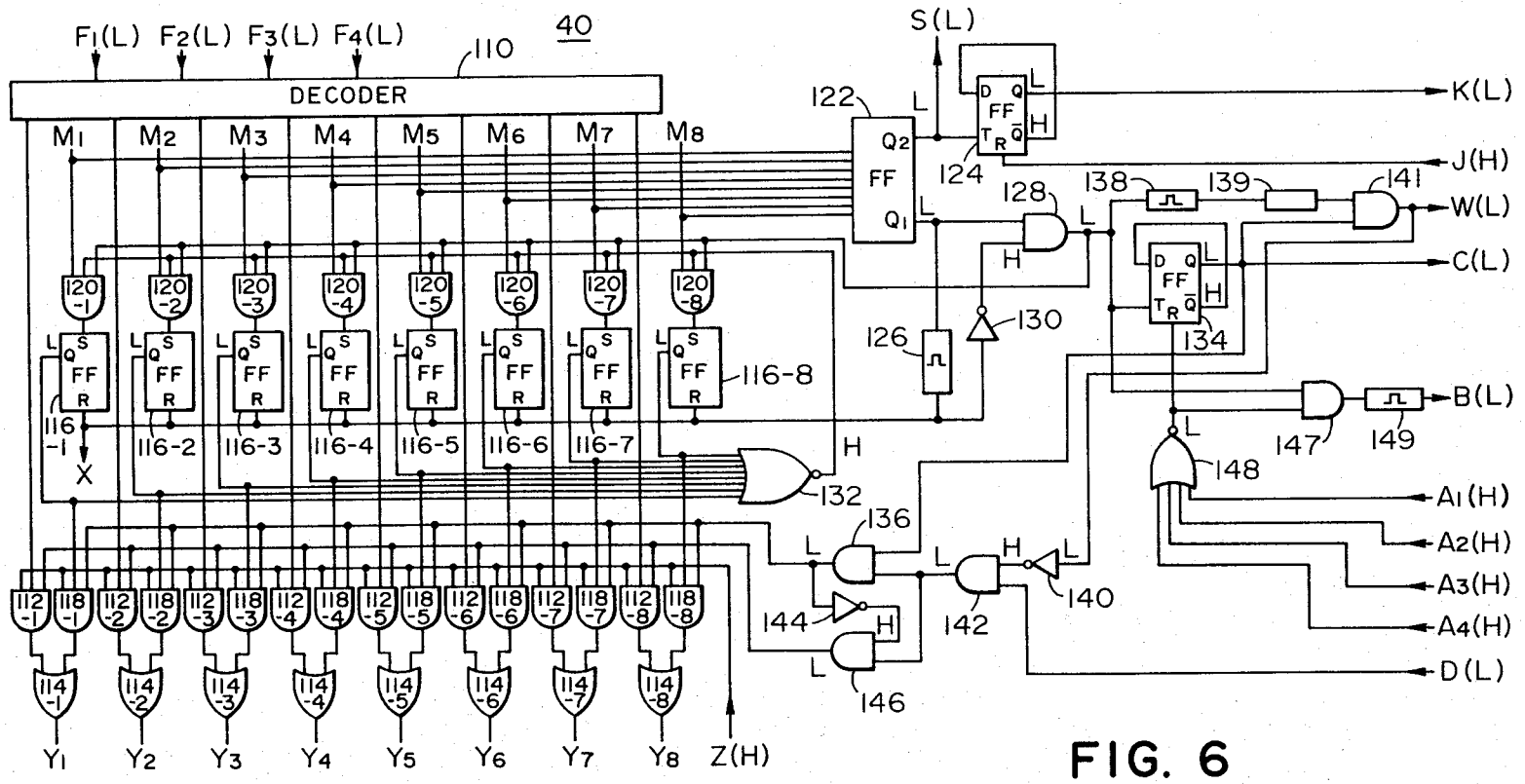
FIG. 6 is a circuit diagram of a time signalling control circuit in FIG. 1.

In FIG. 6, shown therein is a concrete circuit composition of the time signalling control circuit 40. The time signalling sound directing signals $F_1$ and $F_2$ and the melody selecting signals $F_3$ and $F_4$ are converted by the decoder 110, and such converted signals are supplied to the above mentioned address counter 34 as the control program signals $Y_1$ through $Y_8$ which form melody sound data reading signals by way of the melody AND gates 112-1 through 112-8 and the OR gates 114-1 through 114-8. Furthermore, the time signalling control circuit 40 has the time striking FF 116-1 through 116-8, and the determined value of such FF 116 is supplied to the address counter 34 as the control program signal Y which forms the time striking sound data reading signal by way of the time striking AND gates 118-1 through 118-8 and the OR gate group 114. The values of the time striking FF group 116 are determined by the ROM program signals $M_1$ through $M_8$ of the ROM 32 supplied by way of the AND gates 120-1 through 120-8, and the ROM program signals M become the time striking commencement jump data and the time striking cycle jump data in FIG. 5. In other words, in the present invention, in order to have the simple circuit composition it is charactorized that the combination of the controlling action of the time signalling control circuit 40 and the memorized contents of the ROM 32 controls the production of the melody sounds and the time striking sounds, and that the memorized data of the ROM 32 is fed back to the time signalling control circuit 40 to perform respective controlling actions.

In order to perform the above mentioned controlling action the time signalling control circuit 40 has a ROM memory decoder 122 and outputs the $Q_1$ and $Q_2$ corresponding to the ROM programming signal M. The output $Q_2$ of the decoder 122 is used for the afore-mentioned time signalling completion signal S, and triggers the FF 124 to output the melody reset signal K. The FF 124 is in the reset state by the reset signal J together with the afore-mentioned address counter 34. On the other hand, the $Q_1$ output of the decoder 122 does not only reset the time striking FF group 116 by way of the one shot circuit 126 but also is applied to the one input of the AND gate 128. Furthermore, the output of the one shot circuit 126 is supplied to the AND gate 96 of the above mentioned time striking counter 38 as the time striking count up signal X. To the other input of the AND gate 128 is supplied the output of the one shot circuit 126 by way of the inverter 130 and the output of the AND gate 128 is supplied to the AND gate group 120 to control the writing of the ROM program signal M into the time striking FF group 116. The ON action of the AND gate group 120 is further controlled by the time striking FF group 116 itself. In other words, each of the Q outputs from the FF group 116 is supplied to the AND gate group 120 by way of the NOR gate 132, and it is only in the reset state of all the FF 116 that the writing determination of the ROM program signal M is allowed.

The output of the AND gate 128 is further applied to the trigger input of the FF 134 and the Q output of the FF 134 is supplied to the time striking counter 38 as the time striking commencement signal C. The output of the AND gate 128 is applied to the trigger input of the FF 134, and the Q output of the FF 134, that is, the time striking commencement signal C is supplied to the one input of the AND gate 136. The output of the AND gate 128 is applied to the one input of the AND gate 141 by way of the one shot circuit 138 and the delay circuit 139, and to the other input of the AND gate 141 is applied the Q output of the FF 134. Thus, from the AND gate 141 is output the time striking reset signal W while the time striking reset signal W is supplied to the one input of the AND gate 141 by way of the inverter 140. To the other input of the AND gate 142 is supplied the Q output D of the FF 106 in the afore-mentioned address counter 34, and the output of the AND gate 142 is supplied to the other input of the afore-mentioned AND gate 136, the output of which controls the time striking AND gate group 118. The output of AND gate 136 is supplied to the one input of the AND gate 146 by way of the inverter 144, and to the other input of the AND gate 146 is supplied the output of the afore-mentioned AND gate 142. The output of the AND gate 146 controls the melody AND gate group 112. To the reset input of the above mentioned FF 134 are supplied the time striking completion signals $A_1$ through $A_4$, and the FF 134 is reset in the reset statw of all the FF group 80 in the time striking counter 38.

The output of the AND gate 128 and the output of OR gate 148 are supplied to the AND gate 147, and the output of the AND gate 147 is converted into the time striking completion address signal B by way of the one shot circuit 149 to be supplied to the OR gate 107 of the address counter 107 of the address counter 34.

The time signalling control circuit 40 is composed of the circuit described heretofore. The ROM memory decoder 122 reads the time signalling completion data of the ROM 32, the time striking commencement jump data and the time striking cycle jump data, and stops the time signalling action by the output of the time signalling completion signals S in completion of time signalling at "15 minutes", "30 minutes" and "45 minutes". On the other hand, at the hour the $Q_1$ output reads the time striking sound data out of the ROM 32, and the time striking sounds repeat the time striking action until the production of the sounds completes the numbers determined by the time striking counter 38.

Figure 7:
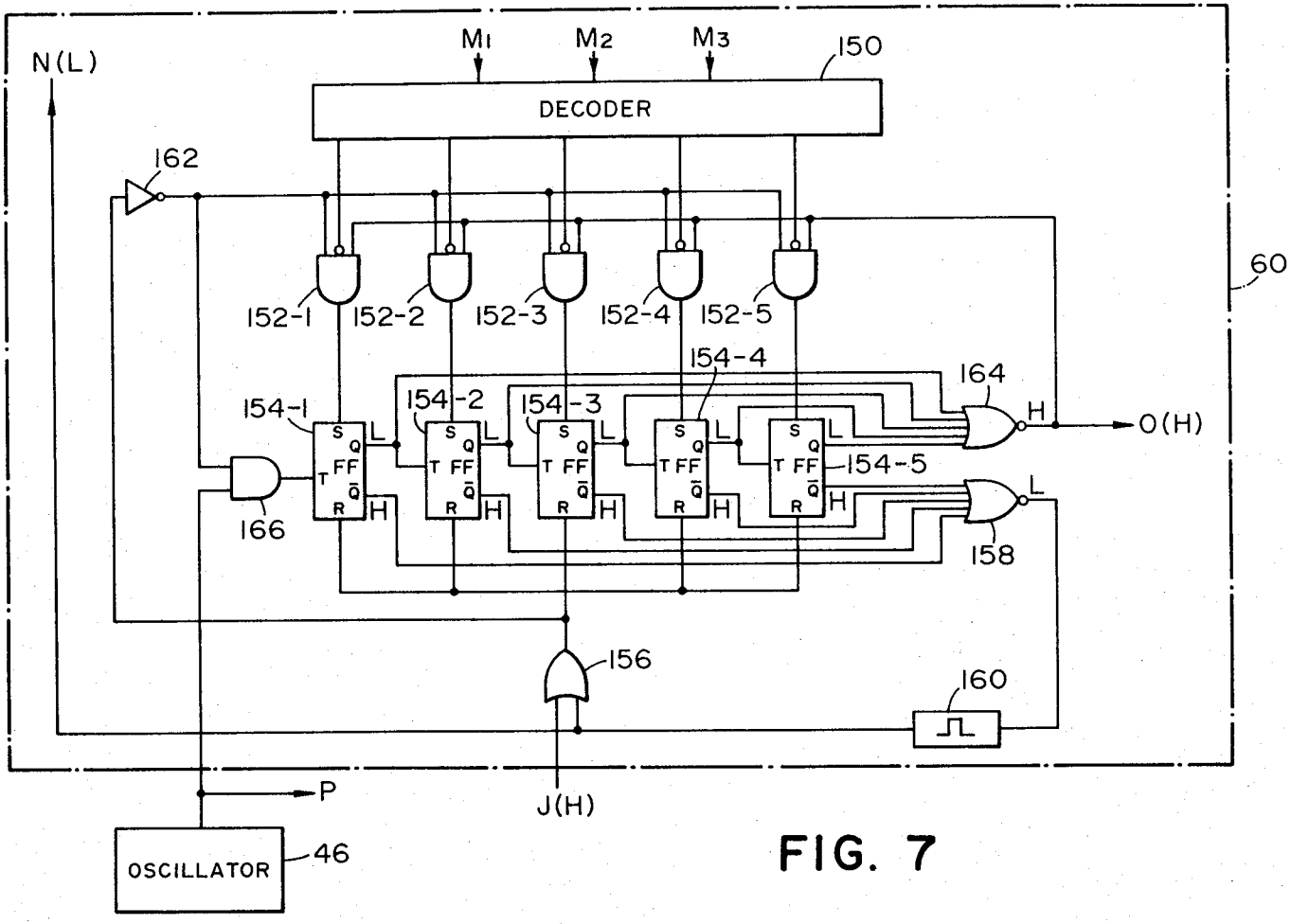
FIG. 7 is a circuit diagram showing a musical note length counter in FIG. 1.

In FIG. 7, shown therein are the musical note length counter 60 and the oscillator 46 of the sound generator 44, and the selected melody sounds or the musical note length corresponding to the time striking sounds are determined there. The musical note length directing signal is formed by the ROM program signals $M_1$ through $M_3$ of the ROM 32. In order to obtain the requested musical note length the musical note length directing signal is converted into the signal of five bit by the decoder 150 and the signal is determined in the FF group 154 which forms the subtracting counter by way of the AND gate group 152. Each of the FF 152 is reset by the reset signal J which is supplied by the OR gate 156, and is also reset by the supply of the output of the NOR gate 158, which the $\overline{Q}$ outputs of the FF 154 are connected to, to the OR gate 156 by way of the one shot circuit 160. The output of the OR gate 156 is supplied to the AND gate group 152 by way of the inverter 162, and the gate ON signal is supplied to the AND gate group 152 only when the reset signal is not provided. The Q outputs of the FF group 154 are supplied to the inputs of the AND gate group 152 by way of the NOR gate 164, and it is in the reset state of all the FF 154 that the signal from the decoder 150 is determined at the FF group 154. The writing of the following signal is stopped until the determined value is reset, and the musical note length counter advances during this time. In order to advance the musical note length counter, the basic sound signal P of the oscillator 46 is put into the trigger input of the first stage of the FF 154 by way of the AND gate 166, and the requested length of the musical note is obtained by counting the basic sound signal P. To the other input of the AND gate 166 is supplied the output of the inverter 162, but the basic sound signal P is not counted in the reset state of the counter.

As described heretofore, from the NOR gate 164 of the musical note length counter 60 is supplied the musical note length signal O of "H" level during musical note length in accordance with the ROM program signals $M_1$ through $M_3$ which are determined by way of the decoder 154, and the musical note length signal O controls the envelope circuit 58. Furthermore, from the NOR gate 158 of the musical note length counter 60 is supplied the musical note count up signal N which has a fixed pulse width by way of the one shot circuit 160 after the determined musical note length elapses, and the signal N controls the advance of the afore-mentioned address counter 34.

Figure 8:
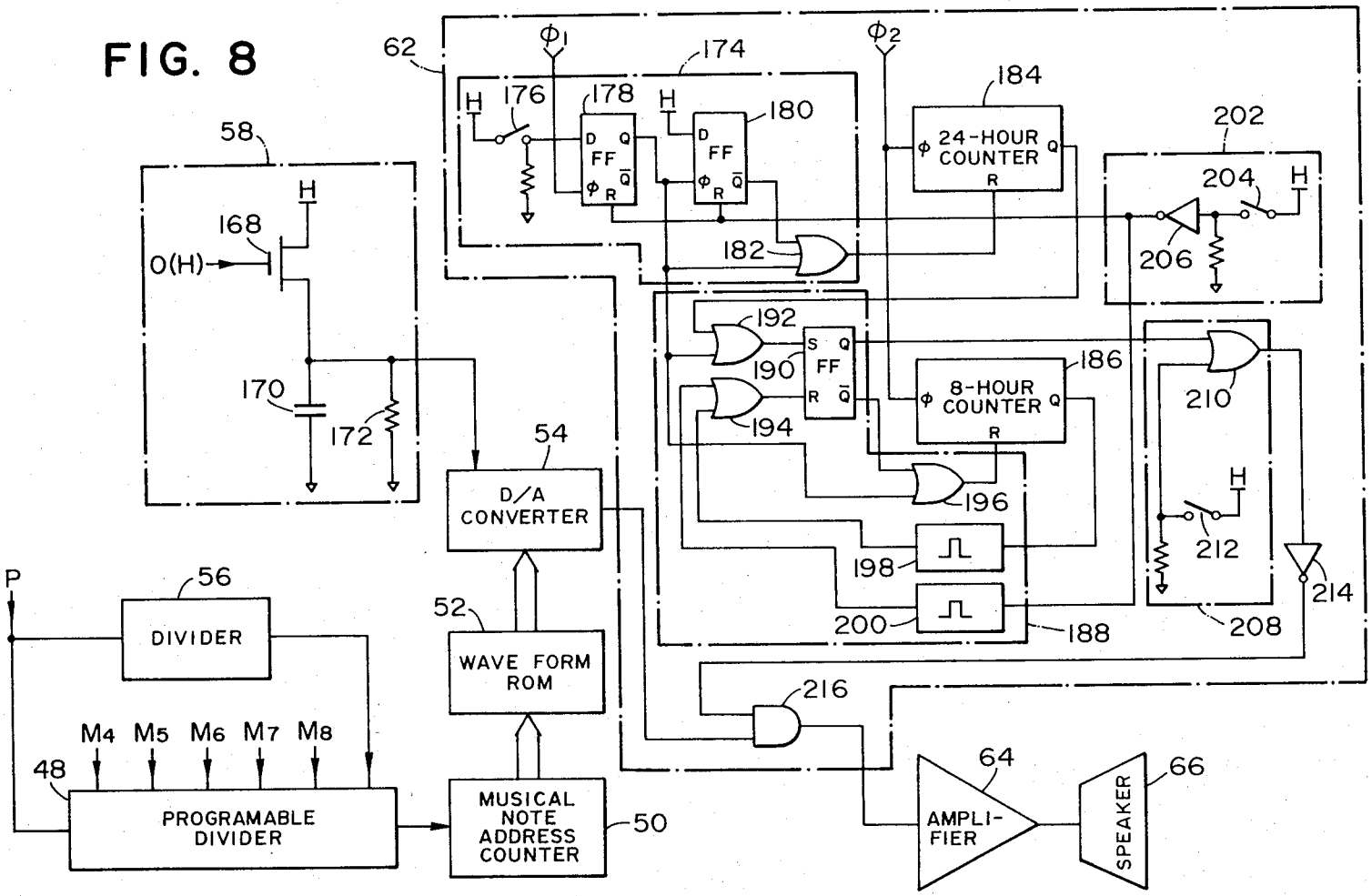
FIG. 8 is a circuit diagram showing a portion of sound generator in FIG. 1.

In FIG. 8, shown therein is the rest of the sound generator 44. The ROM program signals $M_4$ through $M_8$ of the ROM 32 are applied to the programmable divider 48 as the musical note selecting signals, and the values of the signals determine the dividing ratio of the programmable divider 48. Consequently, the programmable divider divides the oscillating frequencies of the basic sound signal P to obtain the necessary musical scale frequencies for the melody or time striking sounds. On the other hand, the basic sound signal P is applied to the divider 56 at the same time, and the low frequency signal for vibratos is supplied to the least significant bit of the programmable divider 48 from the divider 56. Consequently, the dividing ratio of the programmable divider 10 varies in accordance with the change of the low frequency signal for vibratos, and the vibratos effect can be added to the electronic melody sounds or the time striking sounds. Accordingly, the sounds from the speaker 66 are produced with the requested vibration, and the rich and comfortable sounds which the natural sounds and the musical instrument sounds have can be obtained.

Furthermore, to the D/A converter 54 are supplied the envelope signal from the envelope circuit 58, and the envelope signal is formed with the signal attenuating as the time elapses. The sounds from the speaker 66 are, therefore, output as the sounds close to the natural sounds which are attenuated as the time elapses to perform comfortable sound producing action. The envelope circuit 58 includes the discharge circuit composed of the FET 168 which the musical note length signal O is put in, a capacitor 170 and a resister 172, and upon musical note length count is output the envelope signal which attenuates at the determined time constant. The afore-mentioned envelope action can be obtained by superimposing the envelope signal and the output of the wave form 52 at the D/A converter 54.

The sound generator 44 in the embodiment further includes the time signalling pausing circuit 62 and the time signalling action can be halted during the predetermined period when the time signalling sounds are not required, sleeping time for example.

The time signalling pausing circuit 62 includes the time signalling pausing switch circuit 174, which is composed of a switch 176, FF 178 and 180, and an OR gate 182. The FF 178 is driven by the switch 178, and the Q output of the FF 178 and the $\overline{Q}$ output of the FF 180 are connected to the OR gate 182. The output of the OR gate 182 is supplied to the reset input of the 24 hour counter 182 2hich detects the time signalling reset starting time.

The time signalling pausing circuit 62 in this embodiment includes the eight hour counter 186 which counts the time signalling pausing hours as well as the time signalling pausing circuit 62 has the above mentioned 24 hour counter 184. A pausing control circuit 188 includes the FF 190. The Q output of the 24 hour counter 184 and the Q output of the FF 178 are applied to the set input of the FF 190 by way of the OR gate 192, and the output of the OR gate 194 is applied to the reset input. The $\overline{Q}$ output of the FF 190 and the Q output of the FF 178 in the above mentioned time signalling pausing switch circuit 174 are applied to the reset input of the eight hour counter 186 by way of the OR gate 196. The pausing control circuit 188 includes the one shot circuits 198 and 200. The Q output of the eight hour counter 186 is applied to the OR gate 194 by way of the one shot circuit 198, and the output of the pause release switch circuit 202, which is described afterwards, is applied to the OR gate 194 by way of the one shot circuit 200. The pause release switch circuit 202 includes a switch 204 and an inverter 206, which reset both of FF 178 and FF 180 in the time signalling pausing switch circuit 174.

The Q output of the FF 190 in the pausing control circuit 188 is applied to the OR gate 210 of the time signalling forbidden switch circuit 208, and to the other input of the OR gate 210 supplied is the output of the switch 212. The output of the OR gate 210 is applied to the one input of the AND gate 216 by way of the inverter 214, and to the other input of the AND gate 216 applied is the output of the D/A converter 54 of the sound generator 44. Furthermore, the output of the AND gate 216 is applied to the amplifier 64.

The time signalling pausing circuit 62 in this embodiment is composed as described heretofore, and the action of this circuit is described in the following.

In closing the switch 212 of the time signalling forbidden switch circuit 208 the signal "L" is always applied to the AND gate 216 by way of the inverter 214. Consequently, the closure of the switch 212 obstracts supplying the output of the D/A converter 54 to the amplifier and the time signalling action is halted during this time.

In the ordinary using conditions, the above mentioned switch 212 is open. When the switch 204 of the pause release switch circuit 202 is closed in such state, the output becomes "L" signal to release the reset state of the FF 178 and 180 in the time signalling pausing switch 174. When the switch of the time signalling pausing switch circuit 174 is temporarily switched on, "H" signal is supplied to the FF 178. In such state the apply of the clock pulse $\phi_1$ makes the Q output of the FF 178 into "H", and, when the above mentioned switch 176 is opened afterwards, the Q output of the FF 178 returns back to "L" by the rise of the clock pulse.

Consequently, the trigger pulse is generated at the Q output of the FF 178. The rise of the trigger pulse changes the $\overline{Q}$ output of the FF 180 from "H" to "L" to release the reset state of the 24 hour counter 184, and the counter 184 starts counting the clock pulse $\phi_2$.

On the other hand, the $\overline{Q}$ output of the FF 178 sets the FF 190 of the pausing control circuit 188, and the time signalling pausing action starts since the Q output of the FF 190 activates the time signalling forbidden switch circuit to make the AND gate be in the gate OFF state by way of the inverter 214 in the same manner as described in the above. At the same time, the Q output of the FF 178 releases the reset state of the eight hour counter 186, and the counter 186 starts counting the clock pulse $\phi_2$.

After eight hours elapse from the start of the pause mentioned in the above the Q output is generated from the eight hour counter 186, and the FF 190 of the pausing control circuit 188 is put in the reset state by way of the one shot circuit 198 and the OR gate 194 to make the output of the time signalling forbidden switch circuit 208 into "L", and further, the AND gate 216 is put in the gate ON state to restart the time signalling action. At the same time, the eight hour counter 186 is also put in the reset state by the FF 190.

After 24 hours elapse from the temporary ON operation of the switch 176 of the time signalling pausing switch circuit 174, the Q output is generated from the 24 hour counter 184 to reset the FF 190 of the pausing control circuit 188 by way of the OR gate 192. Accordingly, the AND gate 216 is again put in the gate OFF state and the time signalling pausing action is started.

As mentioned heretofore, every 24 hour the time signalling action is halted for eight hours, and the selection of requested pause starting time can perform the optional time signalling pause during the unnecessary time of the time signalling. The above mentioned pause starting time is determined by the time of temporary ON-operation of the switch 176, and the determining time can be optionally corrected and changed.

As described heretofore, according to the illustrated embodiment, the optional time period can be selected as the time signalling pausing time, and the optional change of the count value in the eight hour counter 186 in the embodiment can freely determine the time signalling pausing period.

The embodiment of the present invention is composed as described heretofore, and the melody sound and time striking sound generating action in accordance with the present invention is described with reference to FIGS. 9 and 10.

In the illustrated embodiment the requested melody sounds and the time striking sounds in accordance with the members corresponding to the indicated time are produced at the hour, and at 15 minutes interval from the hour, that is, "15 minutes", "30 minutes" and "45 minutes" produced are the requested melody sounds respectively. Each of the melody sounds produced at 15 minute interval is formed out of different kind rows of musical notes.

Figure 9:
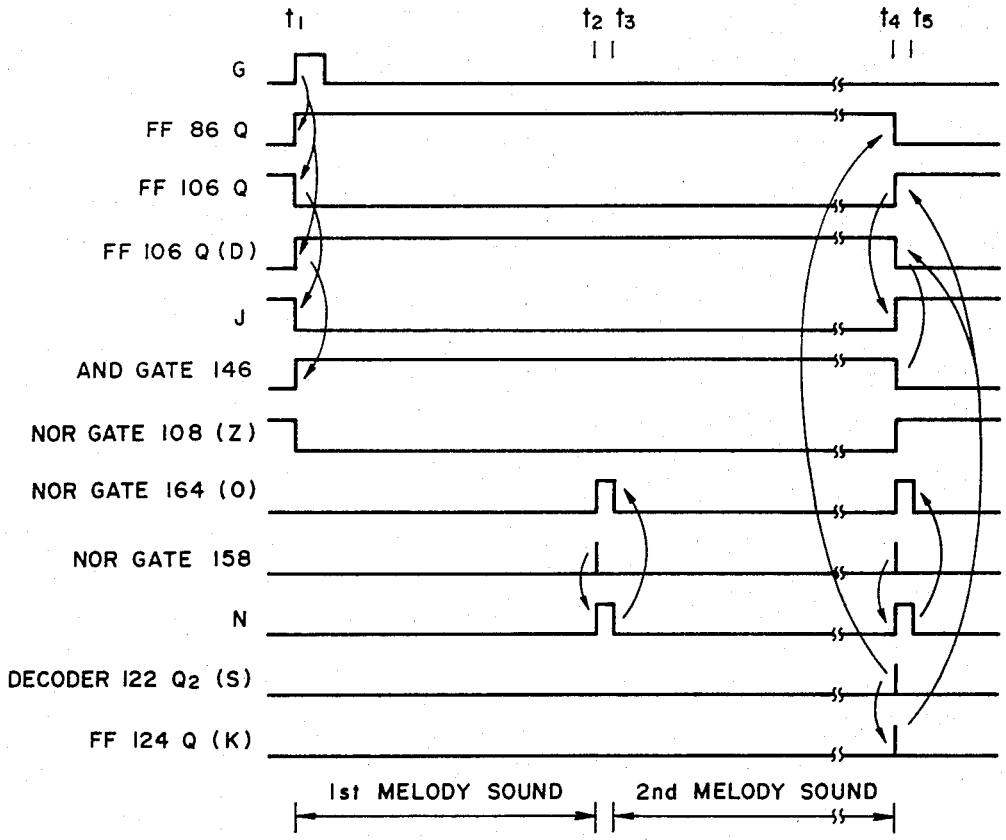
FIG. 9 is a timing chart showing the time signalling action at quarter hour in the embodiment of FIG. 1.

In FIG. 9, shown therein is a melody sound generating action at each quarter hour of "15 minutes" "30 minutes" and "45 minutes" which do not accompany the time striking action, and each of the above mentioned Figures shows such state that the indicating time is ten minutes after two. All the FF are in the reset state to wait for the next melody sound production at the time of "15 minutes".

When the time indicates 2:15 ($t_1$), the time signalling trigger signal G is output for the counter 72 of the time signalling trigger circuit 26 to set the FF 86 of the power saving circuit 36, and makes the operation of the time signalling device effective. Accordingly, the melody selecting signals $F_3$ and $F_4$ selected by the select switch 42 can be supplied to the decoder 110 of the time signalling control circuit 40. The time signalling trigger signal G sets the FF 106 of the address counter 34 to release the reset state of the FF group 102 by the change of the reset signal J into "L". The Q output D of the FF 106 turns to "H", and the gate ON signal is supplied from the AND gate 142 of the time signalling control circuit 40 to the AND gate 146. Consequently, the gate ON signal is supplied to the melody sound AND gate group 112. Thus, the time signalling control circuit 40 supplies the output of decoder 110 out of the AND gate group 112 and the OR gate group 114 to the address counter 34. It is, therefore, understood that the control program signal Y is used as the melody sound data reading signal. Since the above mentioned melody selecting signals $F_3$ and $F_4$ and the time signalling sound directing signals $F_1$ and $F_2$ are supplied to the decoder 110, the melody sounds preselected by a user and the melody sound data reading signal determined by the time signalling sound corresponding to "15 minutes" is established in the FF group 102 of the address counter 34 so that the address reads the melody sound data of "15 minutes" corresponding to the melody $A_2$, for example, out of the ROM 32. And in accordance with the ROM program signal M of the ROM 32 the sound generator 44 is operated to produce the sounds with the predetermined musical note length and musical scale. Since the establishment of the FF group 102 supplies the Q output of "H" from either one of the FF 102 at least to the NOR gate 108, the control program holding signal Z which is the output of the NOR gate 108 becomes "L", and the above mentioned melody AND gate group 112 turns into the gate OFF state to obstruct the supply of the output of the decoder 110 to the FF group 102 until the read of the melody sound data is completed.

The ROM program signal M of the ROM 32 operates the musical note length counter 60. In other words, the established value corresponding to the musical note length is written into the FF group 114 to turn the musical note length signal O into "L" at the same time of such writing, and obstruct the supply of the established value of the decoder 150 to the FF group 154 by means of closing the AND gate group 152 until the sound production of the predetermined musical note length is completed, and further, the afore-mentioned enveloping action of the envelope circuit 58 is started.

At the time of $t_2$ the FF group 154 of the musical note length counter 60 completes counting the predetermined musical note length, and the output of the NOR gate 158 turns into "H" so that the musical note count up signal N having the constant pulse width by means of one shot circuit 160. This musical note count up signal N resets the FF group 164 to wait for the input of the next musical note length signal. At the same time, the musical note count up signal N advances the address counter 34 by one step to read the second musical note data in the melody sound data of the ROM 32. At this time, as previously described, the time signalling control circuit 40 is held back by the control program hold signal Z of the address counter 34, and the contents of the decoder 110 do not effect the address counter at all.

The second ROM program signal M of the ROM 32 is immediately written in the decoder 150 of the musical note length counter 60, and this converted information is written into the FF group 154 at the moment when the output of the one shot circuit 160 gets down and puts the AND gate group 152 in the gate ON state, and the musical note signal O gets down at the same time ($t_3$). At the same time of the write of the first musical note length, the down establishment of the AND gate group 152 again holds the AND gate group 152 and the requested length of sound production is performed at the sound generator 44. The ROM program signal $M_4$ through $M_8$ from the ROM 32 establish the dividing ratio corresponding to the second musical note at the programmable divider 48, and the dividing ratio selected at this time divides the basic sound signal P of the oscillator 46 to process for the sound generating musical note signal.

As described heretofore, when the melody sound data of the ROM 32 are read out one after another to advance the generating action of the electronic sounds synthesized by the sound generator 44 and all of the melody sound data are read out, the ROM 32 reads out the time signalling completion data. The ROM program signal M based on this time signalling completion data operates the ROM memory decoder 122 of the time signalling control circuit 40, and the $Q_2$ output supplies the "H" time signalling completion signal S. This time signalling completion signal S sets the FF 124 to turn the melody reset signal K into "H", and the FF 106 of the address counter 34 is put in the reset state. Accordingly, the FF group 102 of the address counter 34 is totally put in the reset state, and the Q output D of the FF 106 becomes "L" as well as the output of the AND gate 146 in the time signalling control circuit 40 turns into "L" to put the AND gate group 112 in the gate OFF state. Furthermore, the reset signal J of the address counter 32 also resets the musical note length counter 60. At the time of $t_4$ since the "H" signal is momentarily supplied from the NOR gate 158 and operates the one shot circuit 160, the reset state of the FF group 154 continues on until the time of $t_5$, and at the same time, the output of the NOR gate 164 is kept in the "H" state until the time of $t_5$. At the time of $t_5$, the signals mentioned in the above, however, become "L", and the time signalling action of 2:15 is completed. Incidentally, by the reset state of the address counter 34 at the time of $t_4$ the ROM program signal M from the ROM 32 shows the reset data and the ROM memory decoder 122 of the time signalling control circuit 40 immediately inverts its output $Q_2$ into "L".

The time signalling completion signal S resets the power saving circuit 36 and prevent the unnecessary power consumption until next time signalling.

As mentioned in the above, at the time of "15 minutes" the ROM memory decoder 122 of the time signalling control circuit 40 reads the time signalling completion data of the ROM 32 to stop all of the time signalling action, and the time signalling control action can be easily obtained by the cooperating operation between the time signalling control circuit 40 and the ROM 32 without using any complicated circuit composition. The operations at "30 minutes" and "45 minutes" when the time striking sounds are not required are performed as described in the above. In these time signalling states the time signalling sound directing signals $F_1$ and $F_2$ from the time signalling trigger circuit 26 simply change and the corresponding different melody sound data are read out of the ROM 32. In the same manner, in the selection of the melody sounds, the melody sound data of the ROM 32 are selected in accordance with the melody selecting signals $F_3$ and $F_4$ supplied from the switch 42, and the operation of each circuit is same at all as the time of "15 minutes" described in the above.

Figure 10:
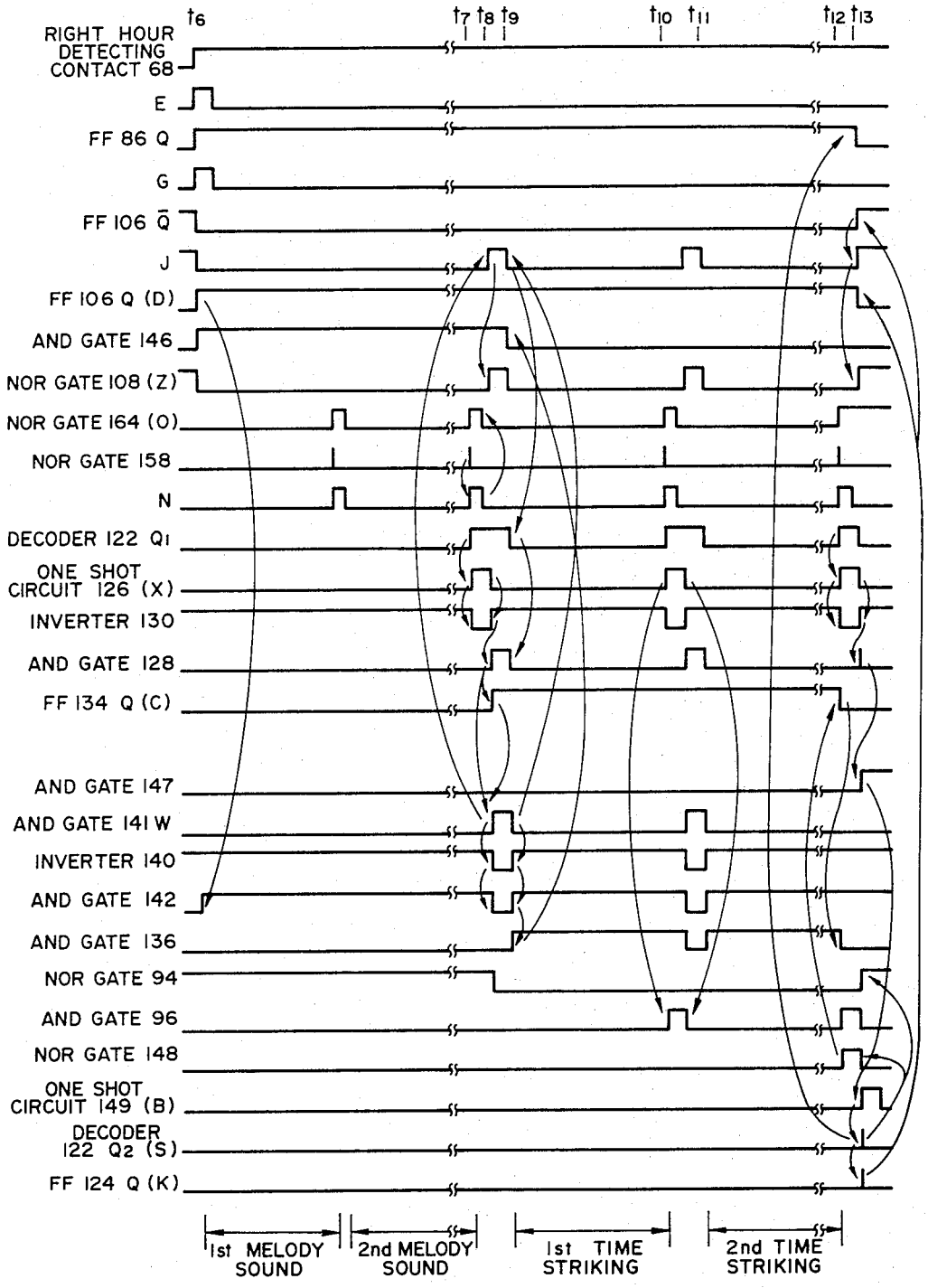
FIG. 10 is a timing chart showing the time signalling action at the right hour in FIG. 1.

The description of the time signalling action at the indicating time of the hour, 3:00 for example, in accordance with FIG. 10. The time signalling device of the present invention performs the melody sounds and the time striking sounds following after the melody sounds at the hour.

In the time chart of FIG. 10, at the indicating time $t_6$ of the hour, which is 3:00 hours, the same action as described in the above in accordance with FIG. 9, and the hour detecting contact 68 is closed to provide the hour signal E of the predetermined pulse width. Accordingly, the power saving circuit 36 starts to supply the power to each of the circuits. The melody sound production at the hour is performed by the data direction of the ROM 32 in the same way as the time of "15 minutes" formarly described. The data of the ROM 32 directed at present time are characterized as the melody sound data accompanying the time striking commencement jump data. The melody sound production accompanying the time striking sound is performed in the same way as formarly described, and the necessary melody sound production is performed one after another. At the time of $t_6$ the AND gate 142 supplies "H", but the output of the gate 136 is kept in "L" since the other input of the AND gate is "L".

At the time of $t_7$ when the reading of the melody sound data corresponding to the hour of the ROM is completed, the time striking commencement jump data is read out of the ROM 32. When this ROM program signal M is supplied to the ROM memory decoder 122 of the time signalling control circuit 40, the decoder 122 changes the $Q_1$ output into "H". Consequently, from the one shot circuit 126 output is the "H" signal having the determined width, and the FF group 116 is put in the reset state. The output of the one shot circuit 126 is inverted at the inverter 130, and the AND gate 128 becomes "H" at the time of $t_8$ since the output of the inverter is "H" at the time of $t_8$ after the time of the pulse width determined by the one shot circuit 126 has elapsed. Accordingly, the gate ON signal is supplied from the AND gate 128 to the AND gate group 120 of the time signalling control circuit 40, and the gate ON signal is also supplied from the NOR gate 132 to each of the AND gate group 120 since all of the FF group are put in the reset state at this time. Consequently, at the FF group 116 written and established are the time striking commencement jump data of the ROM 32.

The "H" output of the AND gate 128 sets the FF 134 to output the time striking commencement signal C of "H" at its Q output. The "H" output of the AND gate 28 operates the one shot circuit 138 to apply the "H" signal alittle delayed by the delay circuit 139 to the one input of the AND gate 141. Furthermore, since the output of the ANF gate 128 sets the FF 134, the Q output of the FF 134 is supplied to the other input of the AND gate 141 to put the AND gate 141 in the gate ON state at the time of $t_8$, and the time striking reset signal W becomes "H" having the predetermined pulse width. The time striking reset signal W is converted by the inverter 140 and the AND gate 142 turns into "L". Accordingly, both of the AND gate groups 112 and 118 is put in the gate OFF state and the control program signal Y is not provided.

The above mentioned time striking commencement signal C supplies the gate ON signal to the AND gate group 78 of the time striking counter 38, and the time striking number signal determined by the time striking number detector 28 is written and established at the FF group 80. At the time of $t_8$ when the time striking numbers are written and established, the output of the NOR gate 94 turns into "L" and hold this established value continuously.

At the time of $t_9$ when it elapses the time of the pulse width of the one shot circuit 138 after the time of $t_8$ the time striking reset signal W becomes "L" and the AND gate 142 is put in the gate ON state by way of the inverter 140 so that the AND gate 136 is put in the gate ON state. At this time, since the control program hold signal Z of "H" is supplied from the address counter 34 to the time signalling control circuit 40, the AND gate group 118 of the time signalling control circuit 40 is set in the gate ON state, and the time striking commencement jump data written into the above mentioned FF group 116 are written and established at the FF group 102 of the address counter 34 by way of the AND gate group 118 and the OR gate group 114. The ROM 32 reads out the time striking sound data by the time striking commencement jump data written in the address counter 34. Consequently, the $Q_1$ output of the decoder 122 becomes "L", since to the ROM memory decoder 122 of the time signalling control circuit 40 supplied is the ROM program signal M which is different from the one at the time of $t_7$. Since the control program hold signal Z is become "L" at the time of $t_9$ by the establishment of the FF group 102 in the address counter 34, the new writing signal is not supplied to the address counter 34. It is understood that the "L" inversion of the above mentioned address reset signal W changes the reset signal J into "L", and that the reset state of the address counter 34 is released.

As described heretofore, the ROM 32 supplies the time striking data as the ROM program signal M to the sound generator 44 and the predetermined time striking sounds are produced in the same way with the melody sounds.

When the first time striking sound completes its sounding at the time of $t_{10}$, the ROM 32 supplies the time striking cycle jump data following the time striking data as the ROM program signal M, and the ROM memory decoder 122 again generates the "H" signal at its $Q_1$ output of the data. The time striking count up signal X is supplied from the one shot circuit 126 so that the AND gate 96 is set in the gate ON state to advance the FF group 80 of the time striking counter 38 by one step, since the time striking commencement signal C is "H" at the time of $t_{10}$, which is different from the time at $t_7$. Accordingly, the operation is repeated in the same way at the time of $t_7$ and the ROM 32 again reads the time striking data to start the second time striking sound at the time of $t_{11}$.

As mentioned in the above, the continuous time striking action is performed and, every time striking action, the FF group 80 of the time striking counter 38 repeats advancing until the struck number becomes equal to the established number at the time striking number detector 28.

At the time of $t_{12}$ when the third time striking action is performed, and all of the FF group 80 of the time striking counter 38 are put in the set state by the time striking count up signal X, from the FF group 80 supplied are the time striking completion signals A ($A_1$ through $A_4$) of "H" to the time signalling control circuit 40, and "H" signal is put out from the NOR gate 148. Consequently, the FF 134 is put in the reset state and the time striking commencement signal C becomes "L", and further, the AND gate 136 is put in the gate OFF state.

The "H" signal of the NOR gate and the output of the AND gate 128 set the AND gate 147 in the ON state at the time of $t_{13}$, and the time striking completion address signal B having the predetermined pulse width from the one shot circuit 149. This time striking completion address signal B advances the FF group 102 by way of the OR gate 107 of the address counter 34, and the time striking completion data is read out of the ROM 32. Consequently, the time signalling completion signal S of "H" is provided at the $Q_2$ output of the ROM memory decoder 122 in the time signalling control circuit 40 to set the FF 124. Accordingly, the FF 106 of the address counter 34 is put in the reset state and the reset signal J becomes "H" to reset the FF group 102. The reset signal J sets the FF 124 and the musical note length counter 60 in the reset state, and the reset of the address counter 34 changes the $Q_2$ output of the ROM memory decoder 122 into the "L" state.

Furthermore, the $Q_2$ output of the decoder 122 mentioned in the above resets the FF 86 of the power saving circuit 36 to cut the power supply by means of the OFF operation of the anolog switch group.

As mentioned in the above, the melody sounds and the time striking sounds at the hour are produced.

Figure 11:
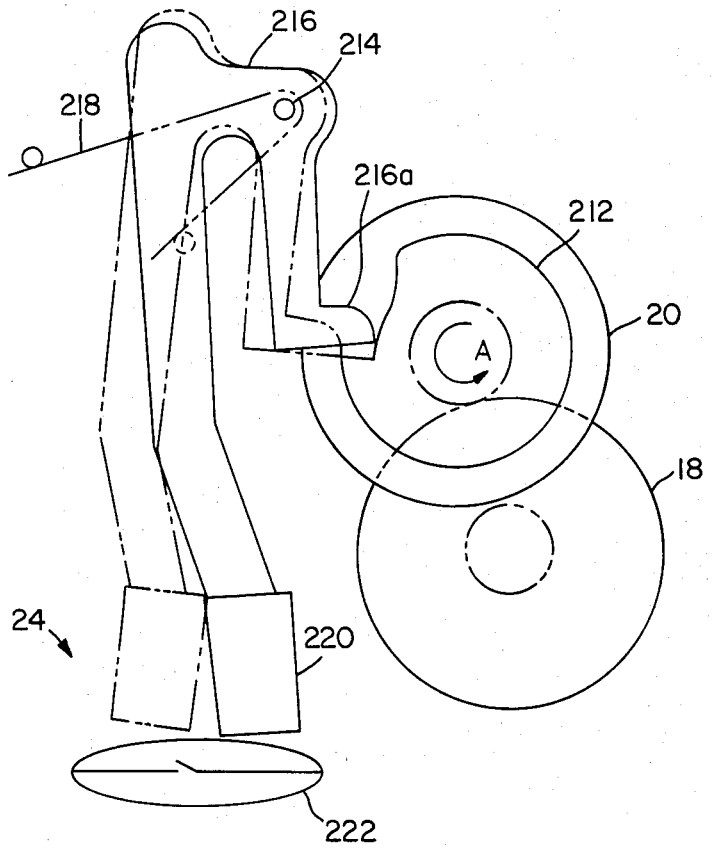
FIG. 11 illustrates a right hour signal detector cooperating with a minute wheel.

Referring to FIG. 11, shown therein is a right hour signal detector 24 cooperating with a minute wheel 20 and which functions as an hour detector. The right hour signal detector 24 includes a cam 212 fixed on a minute wheel 20 which rotates in the direction of the arrow A once every hour and a detecting lever 216 which rotates about a pin 214 which is urged in the counter-clockwise direction by a spring 218. As a result, a cam follower **216*a* is put into engagement with the cam 212. At one end of the detecting lever 216 is provided a magnet 220 which is provided adjacent a reed switch 222** which functions as an electrical contact.

In operation, the detecting lever 16 is normally positioned as shown by the dotted line with the magnet away from the reed switch 222 and the read switch 222 is in an off condition. At the right hour, the cam follower **216*a* engages with the notch in the cam 212 and the detecting lever rotates to the position indicated by the solid line and the reed switch 222** assumes the on condition by causing the electrical contact of the read switch to close.

As described heretofore, according to the present invention, since combination of the data in the ROM 32 installed in the time signalling sound selecting circuit 40 can simplify the circuit composition performing the complicated and multi-functional time signalling action, and can perform the necessary time signalling action by optional selection such as selection of melody sounds and choosing the time striking sounds, it can be of wide use among various timepieces.

Incidentally, the time striking sounds are performed only on the hour in the embodiment, but it is possible to produce at other requested times, "30 minutes" for example, one time of time striking sounds. In this case the time striking commencement jump data are added after the 30 minutes melody sound data of the ROM, and further, one time of the time striking sound signal must be applied from the time striking number detector to the time striking counter 38.

In the embodiment, three different kinds of melody sounds are memorized in the ROM, but the numbers of memorized melody sounds can be optionally determined.

What is claimed is:

1. A time signalling device for a timepiece comprising:

hour signal detector cooperating with a minute wheel in the time indicating gear train to detect hour signal at an indicated time by the ON action of a hour detecting contact;

a time signalling trigger circuit for generating a time signalling trigger signal at a requested time and time signalling sound directing signal based on the hour signal of said hour signal detector;

a time striking number detector having a sliding contact composed of contact disc having a plurality of contact point group facingly installed to an hour wheel in the time indicating gear train for generating a time striking number signal corresponding to an indicated time of the timepiece;

an oscillator generating basic frequencies required to produce melody sounds and time striking sounds;

a programmable divider dividing said basic frequencies from said oscillator to generate frequencies of required musical notes;

a musical note length counter counting said basic frequencies from said oscillator to determine required length of musical notes;

ROM for memorizing melody sound data consisting of dividing ratio data of said programmable divider which produces determined musical notes and objective count value data of said musical note length counter which determines the required length of musical notes, time striking sound data consisting of dividing ratio data of said programmable divider which produces determined musical notes and objective count value data of said musical note length counter which determines the required length of musical notes, time signalling sound completion data, time striking commencement jump data, and time striking cycle jump data;

a time signalling sound selecting circuit having an address counter reading melody sound data and time striking sound data out of said ROM in response to said time signalling trigger signal;

a time striking counter receiving said time striking number signal for setting a number in said time striking counter corresponding to a value of said time striking number signal and for counting down said value and for outputting a time striking completion signal when the value is counted down to zero;

a time signalling circuit outputting requested melody sound data, reading the signal to said time signalling sound selecting circuit in accordance with said time signalling sound directing signal, completing the time signalling action by said time signalling completion data of said ROM, outputting said time striking sound data reading signal to said time signalling sound selecting circuit by said time striking commencement jump data and said time striking cycle jump data of said ROM, and further completing said time signalling action by said time striking completion signal of said time striking counter;

a wave form ROM for memorizing the wave form of predetermined time signalling sounds as digital signals;

an address counter counting signals from said programmable divider to read the data from said wave form ROM one after another;

a D/A converter for converting the data from said wave form ROM to an analog signal; and a sound generator producing the requested time signalling sound in accordance with the analog signal from said D/A counter.

2. A time signalling device for a timepiece according to claim 1 wherein a power saving circuit is installed to supply operating power to each of said circuits only in time signalling operation.

3. A time signalling device for a timepiece according to claim 1 wherein a plurality of melody sound data corresponding to plural and different kinds of melody are memorized in said ROM.

4. A time signalling device for a timepiece according to claim 2 wherein a plurality of melody sound data corresponding to plural and different kinds of melody are memorized in said ROM.

5. A time signalling device for a timepiece according to claim 3 wherein a plurality of melody sound data is optionally selected by means of selecting switch operated by the user.

6. A time signalling device for a timepiece according to claim 4 wherein plurality of melody sound data is optionally selected by means of selecting switch operated by the user.

7. A time signalling device for a timepiece according to either claim 1, 2 or 3 wherein a dividing ratio of said programmable divider is determined by the ROM program signal of said ROM, and a musical note length counter determining the length of generated sounds by said ROM program signal of said ROM.

8. A time signalling device for a timepiece according to claim 4 wherein a dividing ratio of said programmable divider is determined by the ROM program signal of said ROM, and a musical note length counter determining the length of generated sound by said ROM program signal of said ROM.

9. A time signalling device for a timepiece according to claim 5 wherein a dividing ratio of said programmable divider is determined by the ROM program signal of said ROM, and a musical note length counter determining the length of generated sounds by said ROM program signal of said ROM.

10. A time signalling device for a timepiece according to claim 6 wherein a dividing ratio of said programmable divider is determined by the ROM program signal of said ROM, and a musical note length counter determining the length of generated sounds by said ROM program signal of said ROM.

11. A time signalling device for a timepiece according to either claim 1, 2, 3, 4, 5, 6, 8 or 9 wherein said sound generator includes time signalling reset circuit in order to reset the time signalling action during the period optionally determined.

* * * * *